US011323817B2

(12) United States Patent
Bullimore et al.

(10) Patent No.: US 11,323,817 B2
(45) Date of Patent: May 3, 2022

(54) DIAPHRAGM FOR USE IN AUDIO TRANSDUCER AND METHOD OF MANUFACTURING DIAPHRAGM

(71) Applicant: Tymphany Acoustic Technology Limited, Taipei (TW)

(72) Inventors: George Albert Bullimore, Taipei (TW); Garry David Taylor, Taipei (TW); Stuart Martin Hancock, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 16/995,221

(22) Filed: Aug. 17, 2020

(65) Prior Publication Data

US 2021/0058707 A1 Feb. 25, 2021

Related U.S. Application Data

(60) Provisional application No. 62/890,925, filed on Aug. 23, 2019, provisional application No. 62/890,944, filed on Aug. 23, 2019.

(51) Int. Cl.
*H04R 7/12* (2006.01)

(52) U.S. Cl.
CPC ..... *H04R 7/122* (2013.01)

(58) Field of Classification Search
CPC . H04R 9/06; H04R 9/02; H04R 9/045; H04R 9/025; H04R 9/047; H04R 9/04; H04R 9/063; H04R 9/043; H04R 31/003; H04R 31/006; H04R 7/20; H04R 7/125; H04R 7/14; H04R 7/04; H04R 7/12; H04R 7/122; H04R 7/045; H04R 7/06; H04R 7/10; H04R 7/02; H04R 7/24; H04R 7/127; H04R 7/18; H04R 7/16; H04R 2307/021; H04R 2307/025; H04R 2307/023; H04R 2307/029; H04R 2307/207; H04R 1/26; H04R 1/24; H04R 11/00; H04R 2400/03; H04R 2231/001; B06B 1/04; H04M 5/12
USPC ..... 381/398, 396, 423–431
See application file for complete search history.

(56) References Cited

U.S. PATENT DOCUMENTS 4,351,412 A * 9/1982 Yamamuro ..... G10K 13/00 181/170
2005/0253298 A1* 11/2005 Takayama ..... B29C 45/561 264/272.16
2009/0175487 A1* 7/2009 Tsuchiya ..... H04R 7/14 381/425

* cited by examiner

*Primary Examiner* — Ahmad F. Matar
*Assistant Examiner* — Sabrina Diaz
(74) *Attorney, Agent, or Firm* — Muncy, Geissler, Olds & Lowe, P.C.

(57) ABSTRACT

A diaphragm for an audio transducer includes a first outer surface, a second outer surface opposing the first outer surface and a support structure. A skin defines at least one of the first and second outer surfaces of the diaphragm. The support structure is disposed on or within the skin.

8 Claims, 9 Drawing Sheets

DIAPHRAGM FOR USE IN AUDIO TRANSDUCER AND METHOD OF MANUFACTURING DIAPHRAGM

CROSS REFERENCE TO RELATED APPLICATIONS

The present application claims priority to U.S. Provisional Application No. 62/890,925, which was filed on Aug. 23, 2019 and U.S. Provisional Application No. 62/890,944, which was filed on Aug. 23, 2019 the entire contents of which are hereby incorporated by reference.

TECHNICAL FIELD

The present invention relates to a diaphragm for use in an audio transducer and to a method of manufacturing a diaphragm for an audio transducer.

BACKGROUND

In order to optimise performance, audio transducer diaphragms ideally have minimal mass and maximum stiffness (rigidity). Accordingly, it is desirable to form such diaphragms using a minimal amount of a highly rigid material.

Materials which combine stiffness and low density are usually expensive and/or difficult to process. Commonly, the stiffness of a material increases with density, thus creating a trade-off between the stiffness and the mass of the diaphragm.

SUMMARY OF THE INVENTION

The present invention seeks to provide an improved diaphragm for use in an audio transducer, with the aim of overcoming the abovementioned problems. The audio transducer may be a loudspeaker.

According to a first aspect of the present invention, there is provided a diaphragm for use in an audio transducer, the diaphragm comprising a first outer surface, a second outer surface opposing the first outer surface and a support structure, wherein a skin defines at least one of the first and second outer surfaces of the diaphragm, and wherein the support structure is disposed on or within the skin.

The first outer surface and the second outer surface of the diaphragm are opposing since one faces in a first direction and the other faces in a second direction which is generally opposite to the first direction. Preferably, the first outer surface is a front outer surface of the diaphragm, meaning that the first outer surface is arranged to face in a forward direction towards the front of the audio transducer, in use. Accordingly, the second outer surface is preferably a rear outer surface of the diaphragm, meaning that the second outer surface is arranged to face in an opposing direction towards the rear of the audio transducer, in use. The terms "front" and "rear" as used in the present specification are to be interpreted accordingly.

With the arrangement of the present invention, the support structure acts to enhance the rigidity of the skin. Thus, by providing a support structure, the skin may be formed of a relatively low density material, while the required stiffness of the diaphragm is provided by the support structure. The overall mass of the diaphragm can thereby be reduced, whilst simultaneously enhancing the rigidity of the diaphragm and optimising performance.

The feature of the skin defining at least one of the first and second outer surfaces of the diaphragm means that the skin comprises at least one exposed surface which forms the first or second outer surface of the diaphragm. The skin may define only one of the first outer surface or the second outer surface of the diaphragm, with the support structure being disposed on a surface of the skin which opposes its exposed surface. Alternatively, the skin may define both the front outer surface and the rear outer surface of the diaphragm, with the support structure being disposed within the skin. This means that the skin comprises two opposing exposed surfaces which form the first and second outer surfaces of the diaphragm. In some embodiments, the support structure may be wholly embedded within the skin between the first outer surface and the second outer surface of the diaphragm.

The support structure preferably has a higher density than the skin. In some embodiments, the support structure may be made of a first material and the skin made of a second material, different to the first material, the first material having a higher density than the second material. Accordingly, the support structure has a higher density than the skin due to the difference in the relative densities of the first and second materials.

In alternative embodiments of the present invention, the support structure and skin are formed of the same material, wherein the difference in the relative densities of the support structure and the skin is imparted by the manufacturing process. For example, the support structure and/or the skin may be formed by an expansion molding process, wherein the material is expanded in a mold to create a solid cellular structure. The density of the expanded material is dependent upon the mass of material and the volume of space available in the mold. The density of the expanded material can thereby be selected as desired, permitting the support structure and skin to be formed of the same material, whilst at the same time providing a support structure having a higher density than the skin.

The skin may comprise at least one region having a first density and at least one region having a second density, wherein the second density is lower than the first density. Regions of lower density may be provided in areas of the skin which are inaccessible to the user when the diaphragm is assembled within an audio transducer. Accordingly, the mass of the diaphragm can be further reduced, without the risk of the end user damaging the diaphragm surfaces.

The support structure may comprise a frame, the skin being formed around the frame so as to define the first and second outer surfaces of the diaphragm. The frame may be arranged to extend across substantially the entire area of the skin, such that the frame provides a support structure for the skin across the entire skin and thus the rigidity of the diaphragm is enhanced across the entire diaphragm. Preferably, the shape of the frame corresponds substantially to the shape of the diaphragm. In some preferred embodiments, the frame may be shaped as a truncated cone so as to form a substantially conical diaphragm.

In some embodiments, the frame comprises an outer rim defining an outer edge of the frame, and further comprising an inner rim defining an inner opening of the frame. Preferably, one or more apertures are formed between the outer rim and the inner rim so as to reduce the mass of the frame.

In some embodiments, the support structure may comprise a honeycomb structure comprising an array of cells having a predetermined geometry. The cells are hollow cavities defined by an array of interconnecting walls. The cells may be substantially regular. The hollow cavities are preferably of a substantially uniform shape and size. The cells may have a substantially hexagonal geometry, or alternatively may have any other appropriate geometry, such as substantially circular, substantially square or substantially pentagonal. The support structure preferably has a regular pattern of cells. The cells are preferably substantially uniform.

The honeycomb structure provides additional rigidity to the skin by virtue of the inherent rigidity of the honeycomb structure thus increasing the overall stiffness of the diaphragm. Since a large proportion of the honeycomb structure consists of hollow cells the mass of the diaphragm is significantly lower than that of a diaphragm having an equivalent stiffness formed of a solid mass of material.

In one embodiment, some or all of the cells may be filled with a support material, such as a liquid resin or powdered material, which provides a damping effect of the diaphragm, thus contributing to the reduction of unwanted resonances of the diaphragm.

Preferably, at least a portion of the honeycomb structure is formed integrally with the skin. This may be achieved by molding the honeycomb structure (or a portion thereof) together with the skin, for example. By forming the honeycomb structure (or a portion thereof) integrally with the skin, it is not necessary to subsequently join the honeycomb structure to the skin, thus reducing the processing time and reducing or obviating the need for adhesives and/or assembly equipment, thereby reducing the cost of manufacture. Additionally, the structural integrity of the diaphragm is improved, making the diaphragm more robust and resistant to breaking apart.

In some embodiments of the present invention, the skin comprises a front surface defining the first outer surface of the diaphragm, and the honeycomb structure is disposed on a rear surface of the skin opposing the front surface of the skin. In such embodiments, the second outer surface of the diaphragm may be defined by the honeycomb structure. That is to say, the honeycomb structure remains exposed at the rear of the diaphragm.

In alternative embodiments, the skin is a first skin and the diaphragm further comprises a second skin. In such embodiments, the honeycomb structure is disposed between the first and second skins and the second skin defines the second outer surface of the diaphragm. Accordingly, the honeycomb structure is enclosed by the first and second skins.

Preferably, at least a portion of the honeycomb structure is formed integrally with either the first skin or the second skin, providing the abovementioned advantaged of an integrally formed honeycomb structure.

The honeycomb structure may be formed integrally with the first skin, the second skin being joined to the honeycomb structure to form the diaphragm. The honeycomb structure may alternatively be formed integrally with the second skin, the first skin being joined to the honeycomb structure to form the diaphragm.

In alternative embodiments, a first portion of the honeycomb structure is formed integrally with the first skin and a second portion of the honeycomb structure is formed integrally with the second skin, the first and second portions of the honeycomb structure being joined together to form the diaphragm. The first and second portions of the honeycomb structure may preferably be connected by welded joints. Where the first and second portions of the honeycomb structure are welded together, the solidified joint between the first and second portions of the honeycomb structure provides additional rigidity to the diaphragm.

Where the support structure comprises a honeycomb structure, the diaphragm may consist of two components joined together to form the diaphragm. Accordingly, the diaphragm comprising a support structure in the form of a honeycomb structure may be constructed by assembling only two component parts, thus simplifying the manufacturing process.

For example, a first diaphragm component may comprise the first skin and the honeycomb structure and a second diaphragm component may comprise the second skin, the two diaphragm components being joined together by connecting the second skin to the honeycomb structure. Alternatively, a first diaphragm component may comprise the first skin and a first portion of the honeycomb structure and a second diaphragm component may comprise the second skin and a second portion of the honeycomb structure, the two diaphragm components being joined together by connecting the first portion of the honeycomb structure to the second portion of the honeycomb structure.

Each of the two diaphragm components may be formed by molding, machining, 3D printing, thermal forming, casting or any other appropriate method known to a person skilled in the art. Most preferably, each of the two diaphragm components is formed by expansion molding.

The diaphragm according to any of the above described embodiments of the present invention may preferably be formed from a single material, most preferably expanded polypropylene or expanded polyethylene.

According to a second aspect of the present invention, there is provided a method of manufacturing a diaphragm for an audio transducer, the method comprising the following steps performed in any order:

forming a skin shaped so as to define at least one of a front outer surface and rear outer surface of the diaphragm;

forming a support structure; and disposing the support structure on or within the skin.

Preferably, the support structure has a higher density than the skin.

The method may comprise forming the support structure as a first step, and subsequently forming the skin around the support structure, such that the support structure is disposed within the skin. The diaphragm may be formed by molding the skin over the support structure in an over-moulding process, or alternatively the support structure and skin may be sequentially formed in a multiple shot injection molding process.

In preferred embodiments, at least one of the skin and the support structure are formed by an expansion molding process. Such embodiments may comprise:

placing a first expandable material in a first mold and expanding the first expandable material within the first mold to form the support structure;

placing the support structure and a second expandable material in a second mold and expanding the second expandable material within the second mold to form the skin with the support structure disposed within the skin.

The first expandable material and the second expandable material may preferably the same material, wherein the ratio of the mass of expandable material placed within the first mold to the volume of space within the first mold is greater than the ratio of the mass of expandable material placed within the second mold to the volume of space within the second mold. Accordingly, the density of the support structure will be greater than the density of the skin.

In some embodiments, the support structure comprises a honeycomb structure, the method comprising:

forming a first diaphragm component and a second diaphragm component; and joining the first diaphragm component to the second diaphragm component so as to manufacture the diaphragm.

In some embodiments, the skin is a first skin, the first diaphragm component comprises at least a portion of the honeycomb structure formed integrally with the first skin, and the second diaphragm component comprises a second skin, the method comprising joining the second diaphragm component to the first diaphragm component so as to dispose the honeycomb structure between the first skin and the second skin.

In some embodiments, the first diaphragm component may comprise the entire honeycomb structure formed integrally with the first skin. In such embodiments, the step of joining the first diaphragm component to the second diaphragm component includes joining the second skin to the honeycomb structure.

In alternative embodiments, the first diaphragm component may comprise a first portion of the honeycomb structure formed integrally with the first skin, and the second diaphragm component may comprise a second portion of the honeycomb structure formed integrally with the second skin. In such embodiments, the step of joining the first diaphragm component to the second diaphragm component includes joining the first portion of the honeycomb structure to the second portion of the diaphragm structure. In the joining process, the cells of the honeycomb structure of the respective diaphragm component are preferably aligned In any of the above described embodiments comprising joining a first diaphragm component with a second diaphragm component, the two diaphragm components are preferably joined by welding, and most preferably by hot plate welding, ultrasonic welding or vibrational welding. Such welding processes involve melting the material of each component at a respective surface, whereupon said surfaces are brought into abutment and the melted material allowed to cool so as to solidify and fuse the two diaphragm components together. The solidified material at the welded joint has a greater density than material of the respective components, thus the welded joint has the additional advantage of providing additional rigidity to the diaphragm.

BRIEF DESCRIPTION OF THE DRAWINGS

Non-limiting embodiments of the invention will now be described, by way of example only, with reference to the accompanying drawings in which.

DETAILED DESCRIPTION OF THE PREFERRED EMBODIMENTS

Figure 1:
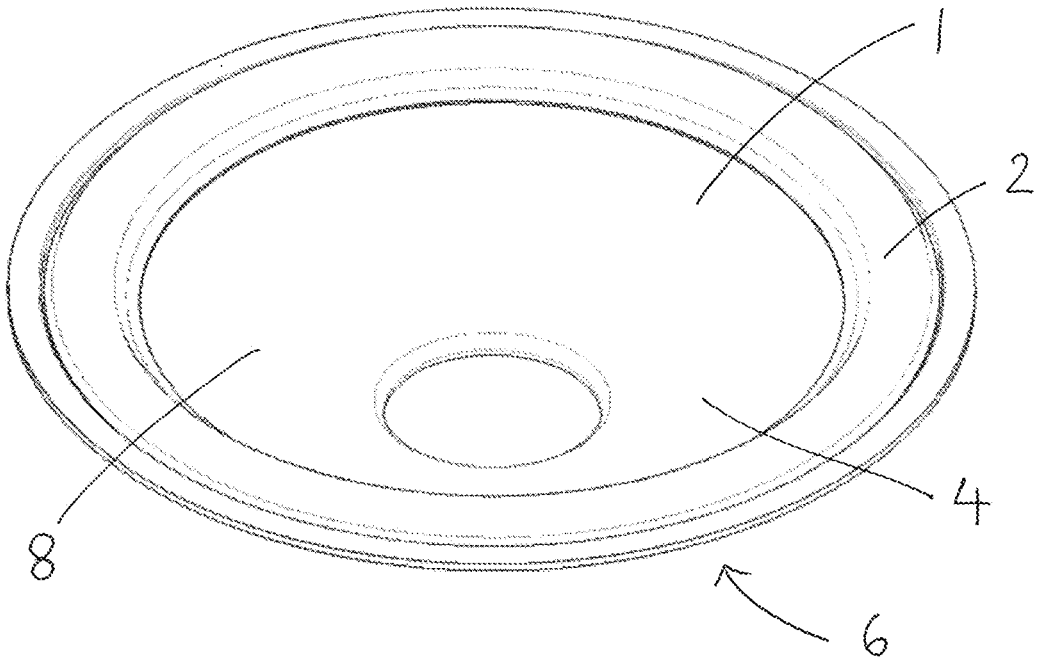
FIG. 1 is a perspective view of a diaphragm in accordance with a first embodiment of the present invention.
Figure 2:
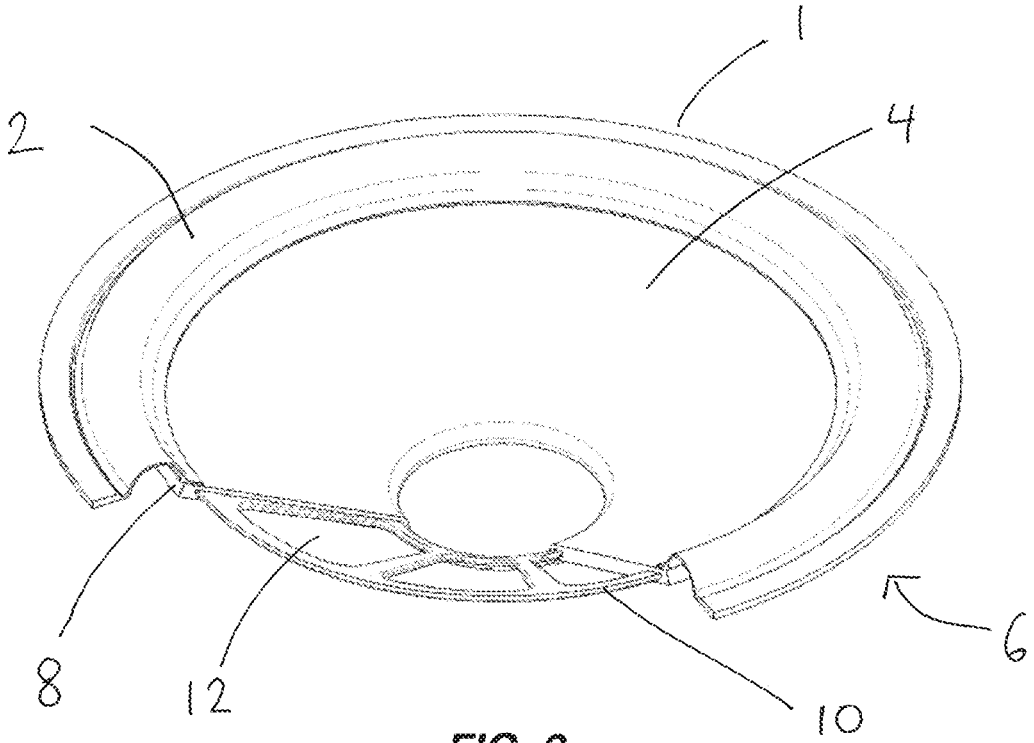
FIG. 2 is a perspective view of the diaphragm of FIG. 1, wherein a portion of the skin is cut away to show the frame.
Figure 3:
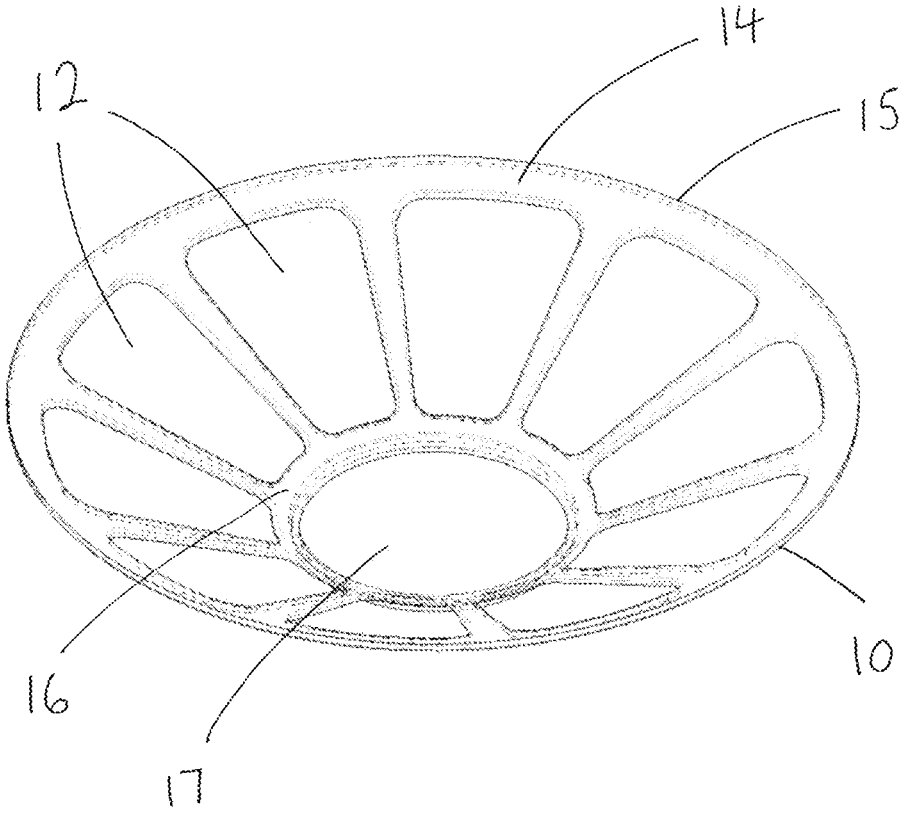
FIG. 3 is a perspective view of a frame of the diaphragm of FIG. 1.
Figure 4A:
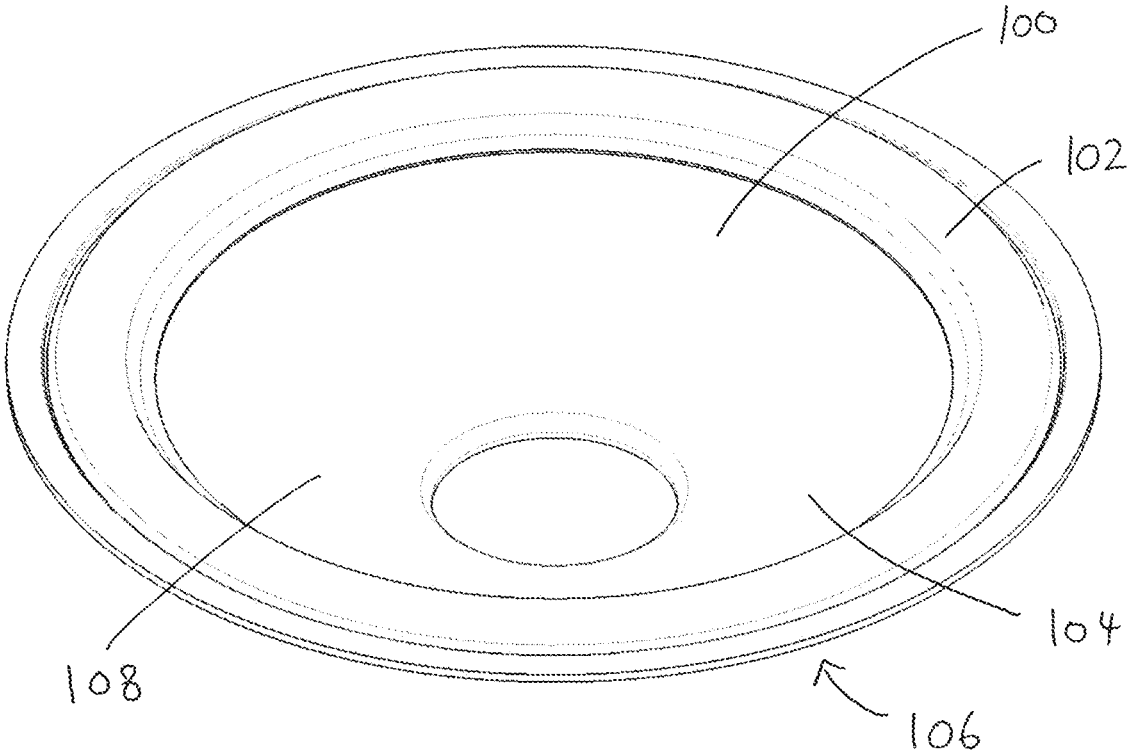
FIG. 4A is a front perspective view of a diaphragm in accordance with a second embodiment of the present invention.
Figure 4B:
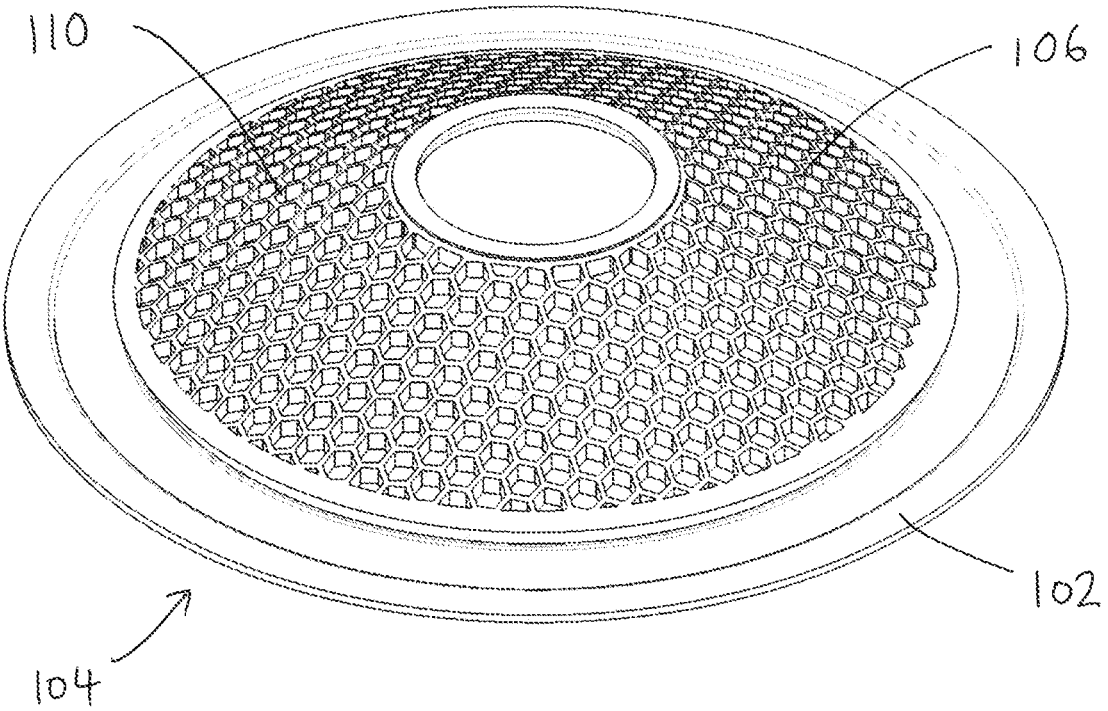
FIG. 4B is a rear perspective view of the diaphragm of FIG. 4A.
Figure 5A:
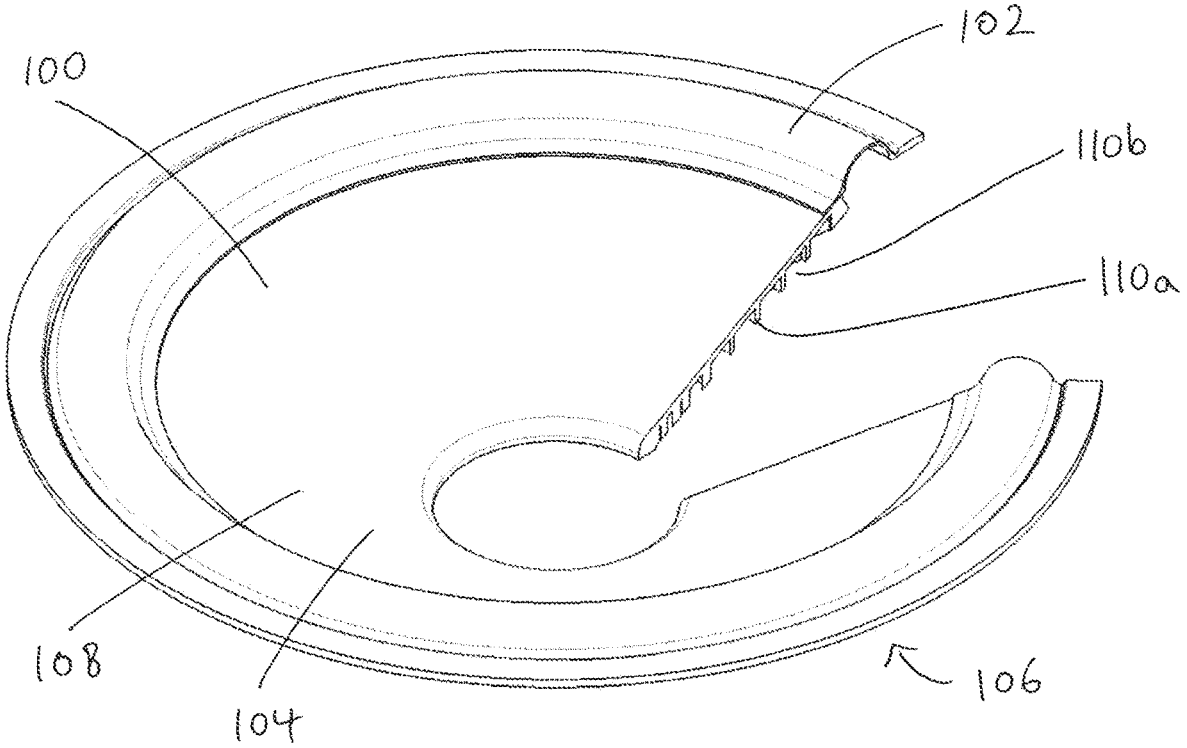
FIG. 5A is a sectioned front perspective view of the diaphragm of FIG. 4A, wherein a section of the diaphragm is cut away.
Figure 5B:
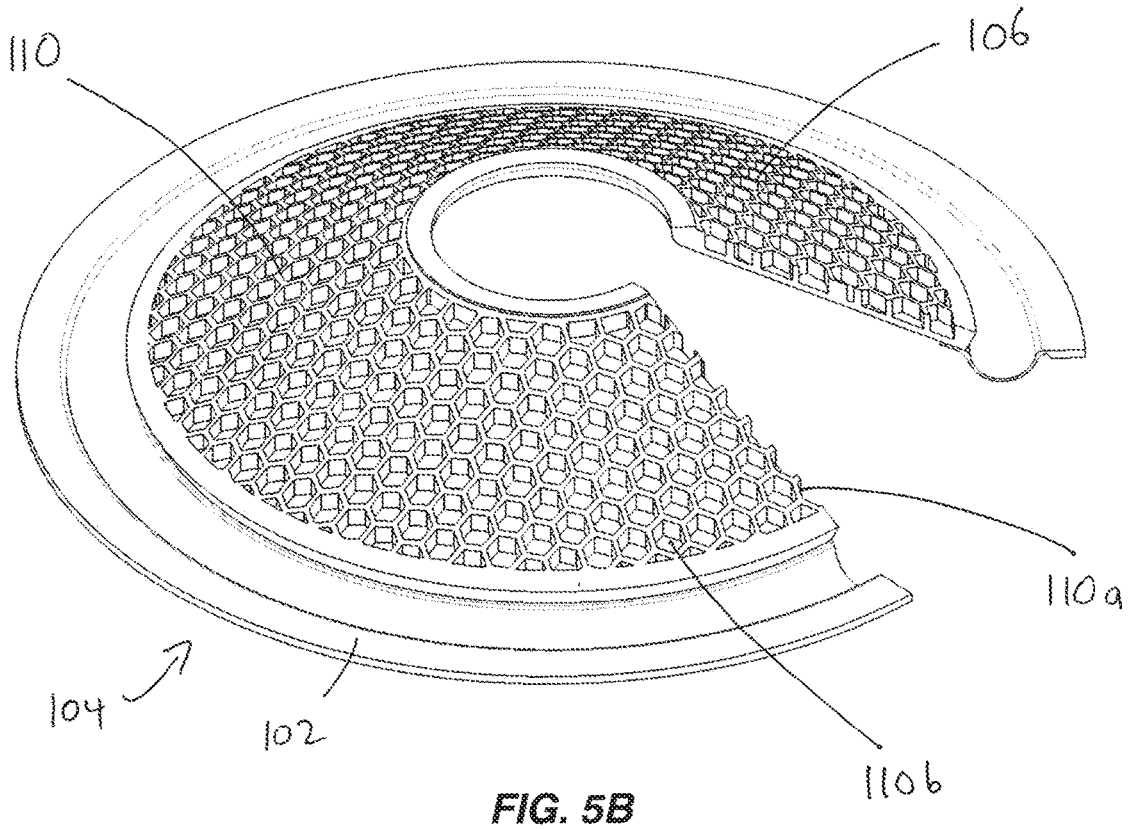
FIG. 5B is a sectioned rear perspective view of the diaphragm of FIG. 4A, wherein a section of the diaphragm is cut away.

With reference to FIGS. 1 to 3, there is shown a diaphragm 1 in accordance with a first embodiment of the present invention. The diaphragm 1 is suitable for use in an audio transducer, for example a loudspeaker. As shown in FIGS. 1 and 2, a surround 2 may be joined to an outer circumference of the diaphragm 1, the surround 2 providing a connection between the diaphragm 1 and an enclosure of an audio transducer (not shown).

The diaphragm 1 comprises a front outer surface 4 and a rear outer surface 6 opposing the front outer surface 4. In use, the front outer surface 4 is arranged to face in a forward direction towards the front of the audio transducer, whilst the rear outer surface 6 faces in an opposing direction towards the rear of the audio transducer. The terms "front" and "rear" as used in the present specification are to be interpreted accordingly.

As shown most clearly in FIG. 2, the diaphragm 1 comprises a skin 8, which skin 8 defines the front outer surface 4 and the rear outer surface 6 of the diaphragm 1. A frame 10 is disposed within the skin 8 between the front outer surface 4 and the rear outer surface 6. In the illustrated embodiment, the skin 8 is formed around the frame 10 such that the frame 10 is wholly embedded within the skin 8.

In the illustrated embodiment, the frame 10 has the shape of a truncated cone and thus defines a substantially conical shape of the diaphragm 1, wherein the front outer surface 4 of the diaphragm 1 has the form of an inverted cone. It will be appreciated that in alternative embodiments, the frame may have any alternative shape so as to provide the diaphragm with a desired geometry. The frame may symmetrical or asymmetrical in shape.

The frame 10 has a higher density than the skin 8 and thus acts as a support structure, providing additional rigidity to the skin 8 and increasing the stiffness of the diaphragm 1. Accordingly, the skin 8 may be formed of a relatively low density material, which permits the overall mass of the diaphragm 1 to be minimised, whilst maintaining the required stiffness to optimise the performance of the diaphragm 1 within an audio transducer.

In order to minimise the mass of the frame 10, and thus to minimise the overall mass of the diaphragm 1, the frame 10 comprises a plurality of apertures 12 formed between an outer rim 14 and an inner rim 16 of the frame 10, as shown most clearly in FIG. 3. The outer rim 14 defines an outer circumference 15 of the frame and the inner rim 16 defines an inner opening 17 of the frame, which in turn define an outer circumference and an inner opening of the diaphragm 1, the inner opening being circular in shape in this embodiment. Accordingly, the frame 10 provides a support structure across substantially the entire area of the skin 8.

The diaphragm 1 may be formed by any appropriate method known to a person skilled in the art. In particular, the diaphragm 1 may be formed using an over-molding process, wherein the relatively low density skin 8 is molded over the preformed, relatively high density frame 10, such that the skin 8 defines the outer surfaces of the diaphragm 1.

In some embodiments, the frame 10 may be made of a first material and the skin 8 made of a second material, different to the first material, the first material having a higher density than the second material. Accordingly, the frame 10 has a higher density than the skin 8 due to the difference in the relative densities of the first and second materials.

However, in preferred embodiments of the present invention, the frame 10 and skin 8 are formed of the same material, for example polypropylene or polystyrene, using an expansion molding process. In an expansion molding process, small particles of the material (for example chips or beads) are placed within a mold and expanded (for example by application of heat and pressure and/or by adding an expansion agent), such that small particles expand and fuse together to create a solid cellular structure, the material filling the space within the mold. The density of the component formed by the process will depend upon the mass to volume ratio: the ratio of the mass of expandable material placed within the mold to the volume of space within the mold during the expansion process. The lower the mass to volume ratio, the greater the extent to which the material is able to expand, and thus the lower the density of the expanded material. Accordingly, the frame and skin of the diaphragm can be formed of the same material by expansion molding the frame using a higher mass to volume ratio than is used for the skin.

With reference to FIGS. 4A to 5B there is shown a diaphragm 100 in accordance with a second embodiment of the present invention. The diaphragm 100 is suitable for use in an audio transducer, for example a loudspeaker. As shown in FIGS. 4A to 5B, a surround 102 may be joined to an outer circumference of the diaphragm 100, the surround 102 providing a connection between the diaphragm 100 and an enclosure of an audio transducer (not shown).

The diaphragm 100 comprises a front outer surface 104 and a rear outer surface 106 opposing the front outer surface 104. In use, the front outer surface 104 is arranged to face in a forward direction towards the front of the audio transducer, whilst the rear outer surface 106 faces in an opposing direction towards the rear of the audio transducer.

The diaphragm 100 comprises a skin 108, which skin 108 has a front surface defining the front outer surface 104 of the diaphragm 100. A honeycomb structure 110 is disposed on a rear surface of the skin 108. The honeycomb structure 110 comprises a structured array of walls 110*a* extending substantially perpendicularly to the rear surface of the skin 108, the walls 110*a* defining an array of substantially uniform hollow cells 110*b* having a predefined geometry. The ends of the walls 110*a* of the honeycomb structure 110 collectively define the rear outer surface of the diaphragm 100. In alternative embodiments, the honeycomb structure 110 may be disposed on a front surface of the skin 108, such that the honeycomb structure 110 defines the front outer surface 104 of the diaphragm.

Figure 6:
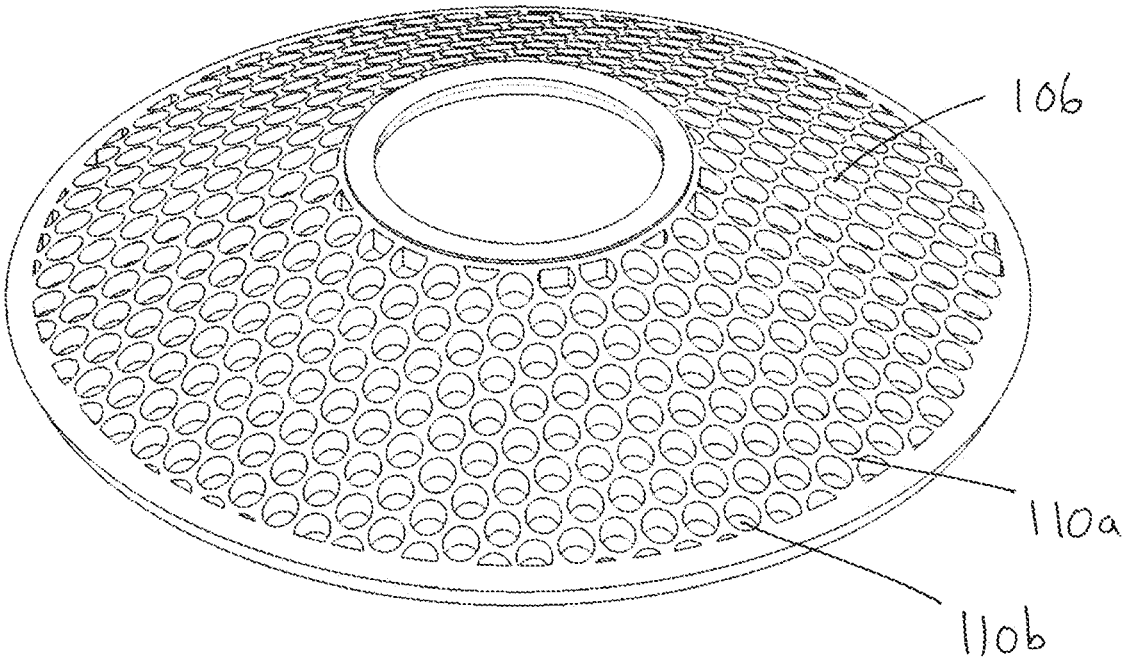
FIG. 6 is a rear perspective view of a diaphragm in accordance with a third embodiment of the present invention.

In the embodiment illustrated in FIGS. 4A to 5B, the hollow cells 110*b* have a hexagonal geometry, however it will be appreciated that alternative embodiments of the present invention may comprise a honeycomb structure having any other appropriate geometry. For example, FIG. 6 shows a third embodiment of the present invention, corresponding substantially to the second embodiment illustrated in FIGS. 4A to 5B, wherein the hollow cells 110*b* have a circular geometry.

In the second and third embodiments illustrated in FIGS. 4A to 6, the honeycomb structure 110 is formed integrally with the skin 108. In alternative embodiments, the skin 108 and the honeycomb structure 110 may be formed as separate components which are subsequently bonded together.

The honeycomb structure 110 acts as a support structure, providing additional rigidity to the skin 108 by virtue of the inherent rigidity of the honeycomb structure 110, thus increasing the overall stiffness of the diaphragm 100. Since a large proportion of the honeycomb structure 110 consists of hollow cells 110*b*, the mass of the diaphragm 100 is significantly lower than that of a diaphragm having an equivalent stiffness formed of a solid mass of material.

Figure 7:
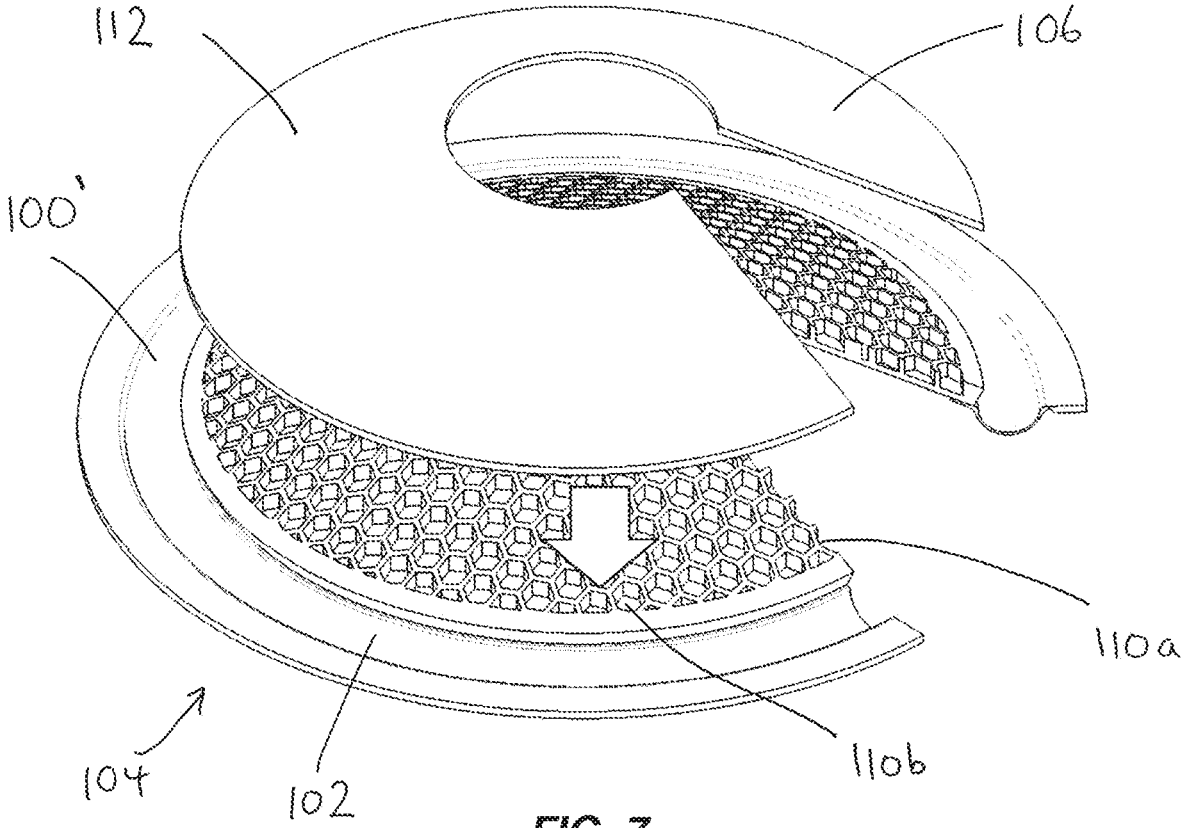
FIG. 7 is a front perspective view of a diaphragm in accordance with a fourth embodiment of the present invention, wherein a second skin of the diaphragm is removed to show the honeycomb structure of the diaphragm.

A fourth embodiment of a diaphragm 100' in accordance with the present invention is illustrated in FIG. 7. The diaphragm 100' corresponds substantially to the diaphragm 100 of FIGS. 4A to 5B and corresponding features are referenced with like numerals. In the embodiment of FIG. 7, the skin 108 is a first skin, the diaphragm 100' further comprising a second skin 112. The honeycomb structure 110 is formed integrally with the first skin 108 such that the walls 110*a* of the honeycomb structure 110 extend from a rear surface of the first skin 108. The second skin 112 is joined to the honeycomb structure 110 at the distal end of the walls 110*a*, so as to enclose the honeycomb structure 110 between the first skin 108 and the second skin 112. The second skin 112 thus defines the rear outer surface 106 of the diaphragm 100'.

The diaphragm 100' of FIG. 7 thus includes only two components: a first component including the first skin 108 and honeycomb structure 110, and a second component including the second skin 112. The two components may be joined together by any appropriate method. For example, the two components may be joined together using a snap joint. In preferred embodiments, the two components may be bonded or welded together and most preferably the two components are welded together using hot plate welding, ultrasonic welding or vibrational welding (described in further detail below). The individual components may be formed by molding, preferably expansion molding, or alternatively may be formed by other suitable manufacturing processes such as machining, 3D printing, thermal forming or casting.

Figure 8A:
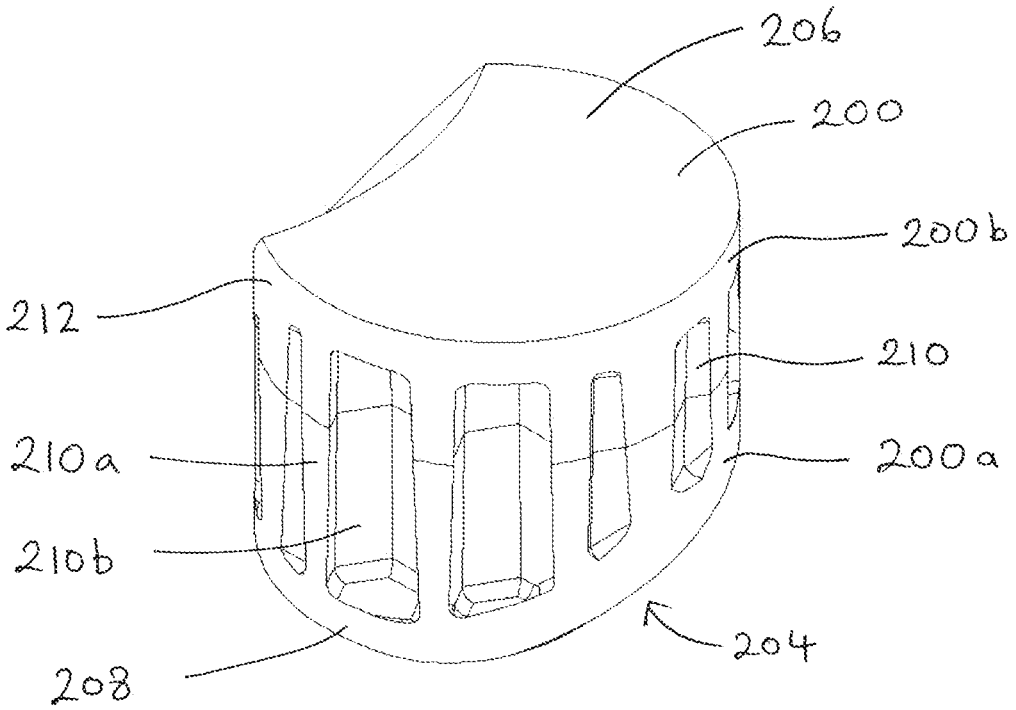
FIG. 8A is a sectioned view of a portion of a diaphragm in accordance with a fifth embodiment of the present invention.
Figure 8B:
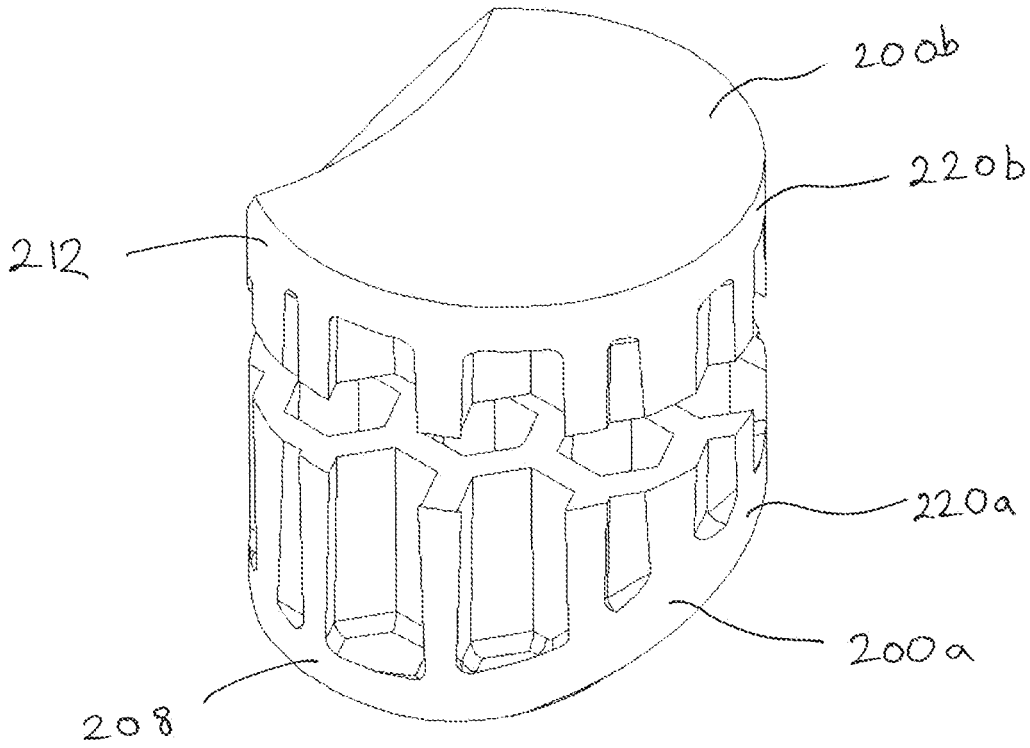
FIG. 8B is a sectioned view of a portion of the diaphragm of FIG. 8A showing two diaphragm components.

FIGS. 8A and 8B show a small section of a diaphragm 200 in accordance with a fifth embodiment of the present invention. The structure of the diaphragm 200 corresponds substantially to the structure of the diaphragm 100' illustrated in FIG. 7, wherein a honeycomb structure 210 is disposed between a first skin 208 and a second skin 212, which define a front outer surface 204 and a rear outer surface 206 of the diaphragm 200, respectively. The honeycomb structure 210 comprises a structured array of walls 210*a* extending substantially perpendicularly to the rear surface of the skin 208, the walls 210*a* defining an array of substantially uniform hollow cells 210*b* having a predefined hexagonal geometry.

The diaphragm 200 is made of two components 200*a*, 200*b*. A first diaphragm component 200*a* is made of the first skin 208 and a first portion 220*a* of the honeycomb structure 210. A second diaphragm component 200*b* is made of of the second skin 212 and a second portion 220*b* of the honeycomb structure 210. Each of the individual diaphragm components 200*a*, 200*b* is formed integrally, the two separate components 200*a*, 200*b* being subsequently joined together to form the complete diaphragm 200. The individual diaphragm components 200*a*, 200*b* may be formed by molding, preferably expansion molding, or alternatively may be formed by other suitable manufacturing processes such as machining, 3D printing, thermal forming or casting.

Figure 9A:
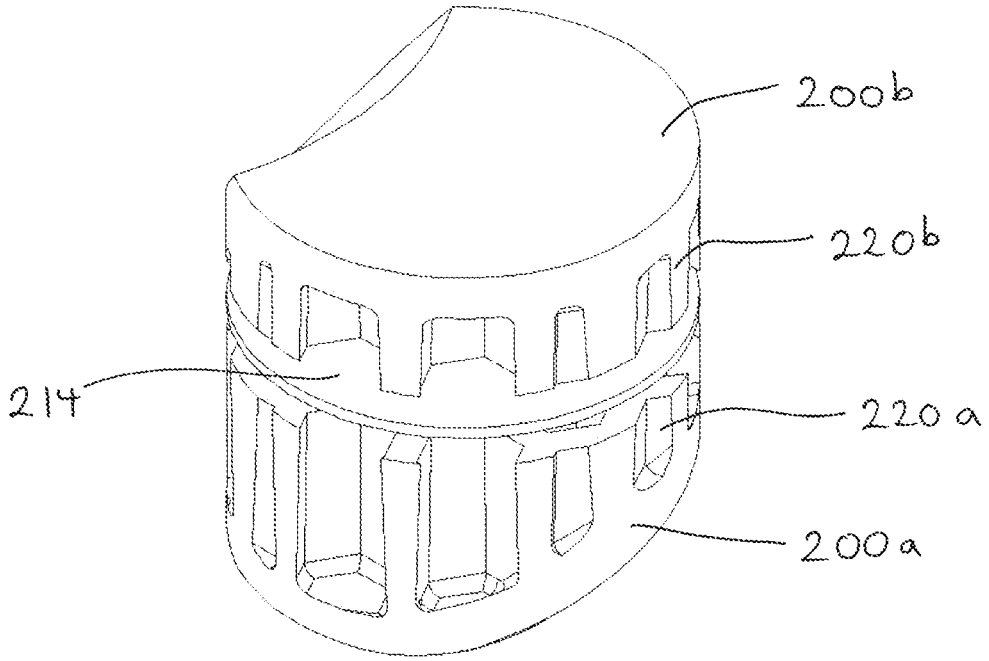
FIGS. 9A to 9D are schematic diagrams illustrating a hot plate welding method for forming a diaphragm in accordance with the present invention.
Figure 9B:
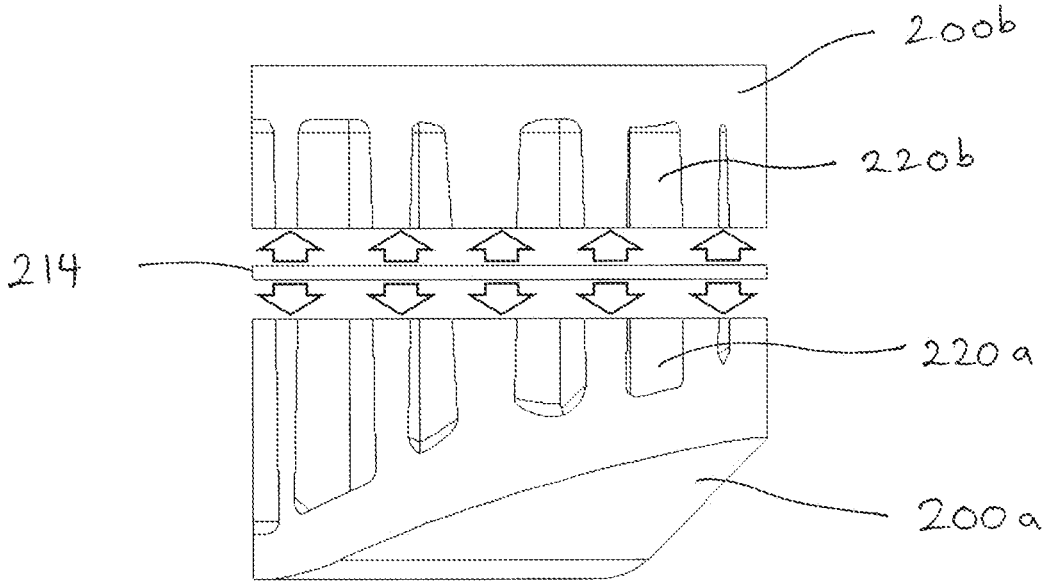
Figure 9C:
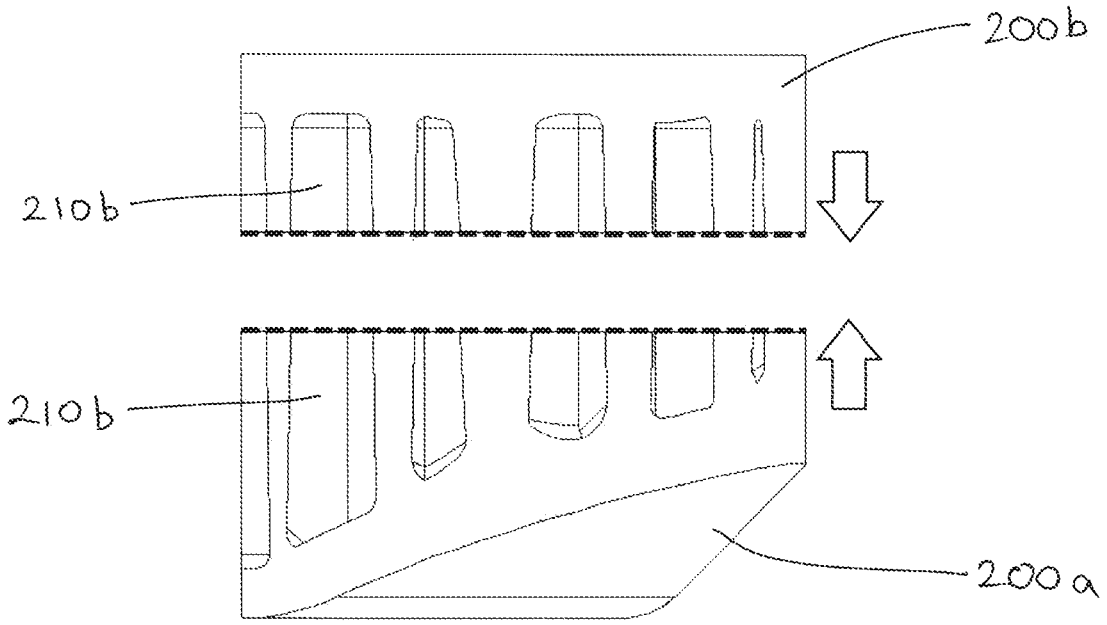
Figure 9D:
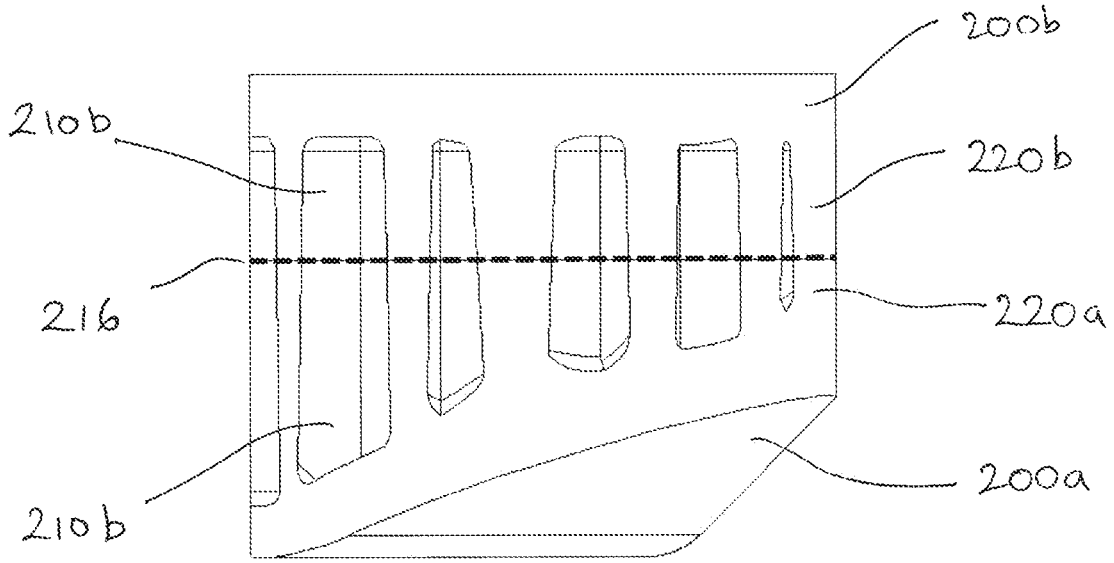

The two diaphragm components 200*a*, 200*b* may be joined by any appropriate means, and are preferably joined using an adhesive-free attachment, most preferably by welding. FIGS. 9A to 9D illustrate a preferred hot plate welding method for joining the two diaphragm components 200*a*, 200*b*. As shown in FIGS. 9A and 9B, the two diaphragm components 200*a*, 200*b* are brought into close proximity to a heated plate 214, wherein the heated plate 214 is located between the exposed surfaces of the first and second portions 220*a*, 220*b* of the honeycomb structure 210. The heated plate 214 transfers heat to the exposed surfaces of the first and second portions 220*a*, 220*b* of the honeycomb structure 210, so as to bring said exposed surface to a temperature above the melting point of the material from which the diaphragm components 200*a*, 200*b* are formed (FIG. 9B). Once the desired temperature has been reached, the heated plate 214 is removed and the two diaphragm components 200*a*, 200*b* are brought together to make contact between the melted surfaces of the honeycomb structure 210 (FIG. 9C). As the melted material cools and solidifies, the respective surfaces of the first and second portions 220*a*, 220*b* of the honeycomb structure 210 are fused together so as to join the two diaphragm components 200*a*, 200*b*. The layer of fused, solidified material joining the respective surfaces of the honeycomb structure 210 forms a joint 216, at which joint 216 the material has a greater density than the rest of the diaphragm. Accordingly, the joint 216 contributes additional stiffness to the diaphragm 200, thus improving the performance of the diaphragm without adding significant mass.

Use of the hot plate 214 enables a controlled and even distribution of heat to the respective surfaces of the honeycomb structure 210. The temperature of the hot plate 214 and the duration of heating can be carefully controlled according to the size of the diaphragm and the material from which it is formed, so as to provide a joint 216 of appropriate strength and rigidity. However, it will be appreciated that direct heat welding using hot air may alternatively be used, provided that a controlled and even distribution of heat to the respective surfaces of the honeycomb structure can be achieved.

Figure 10A:
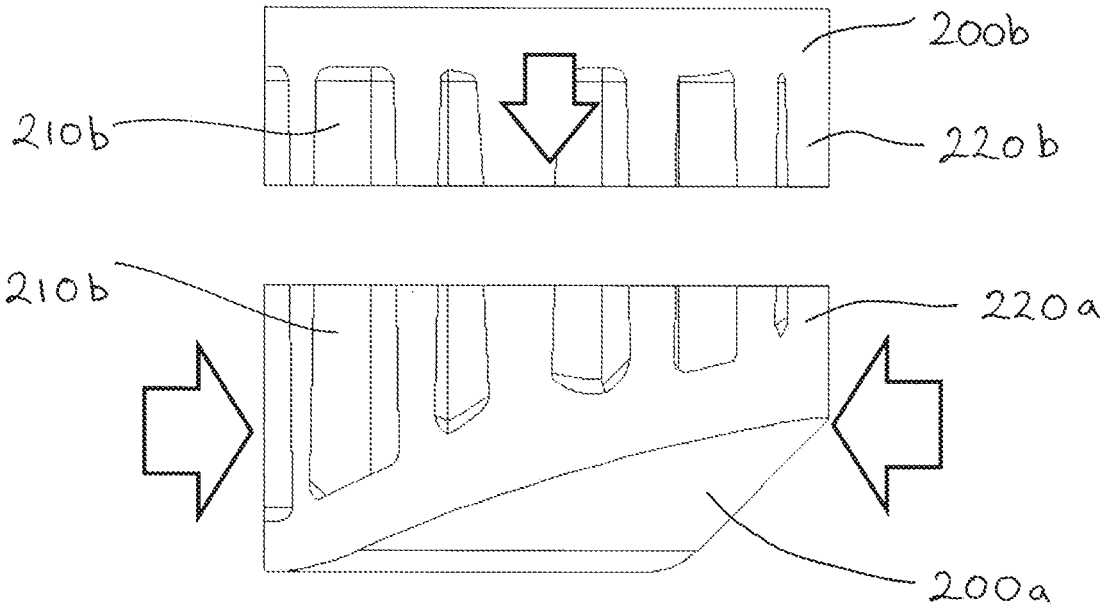
FIGS. 10A and 10B are schematic diagrams illustrating an ultrasonic welding method for forming a diaphragm in accordance with the present invention.
Figure 10B:
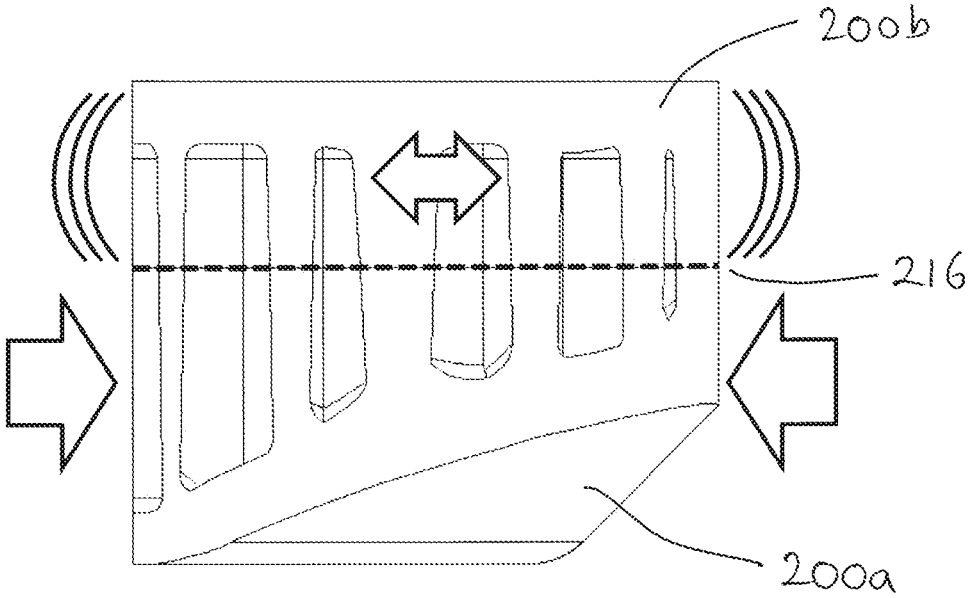

FIGS. 10A and 10B illustrate a further preferred method for joining the two diaphragm components 200*a*, 200*b*, using ultrasonic welding. In the illustrated embodiment, the first diaphragm component 200*a* is held securely so as to remain static during the welding process. The second diaphragm component 200*b* is positioned such that the respective exposed surfaces of the two portions 220*a*, 220*b* of the honeycomb structure 210 are brought into contact, with the hollow cells 210*b* being appropriately aligned. The second diaphragm component 200*b* is held with some pressure against the first diaphragm component 200*a* and is moved reciprocally at ultrasonic frequencies in a direction parallel to the plane of the respective abutting surfaces of the first and second portions 220*a*, 220*b* of the honeycomb structure 210. This rapid movement generates sufficient friction between the abutting surfaces of the first and second portions 220*a*, 220*b* of the honeycomb structure 210 so as to heat the material above its melting point, thus melting the abutting surfaces.

Once ultrasonic movement of second diaphragm component is ceased, the melted material cools and solidifies, permitting the respective surfaces of the honeycomb structure 210 to fuse together so as to join the two diaphragm components 200*a*, 200*b* in the same manner as described above in respect of the hot plate welding method. The layer of fused, solidified material joining the respective surfaces of the honeycomb structure 210 forms a joint 216, at which joint 216 the material has a greater density than the rest of the diaphragm. Accordingly, the joint 216 contributes additional stiffness to the diaphragm 200, thus improving the performance of the diaphragm without adding significant mass.

It will be appreciated that in alternative embodiments, the second diaphragm component 200*b* may be held static and the first diaphragm component 200*a* may be brought into abutment and subjected to rapid movement at ultrasonic frequencies in order to weld the two diaphragm components 200*a*, 200*b* together.

Since the ultrasonic welding process relies on friction between the diaphragm components 200*a*, 200*b*, the effectiveness of the process is dependent on the size and shape of the individual components and the material from which the components are formed. Where the diaphragm components are formed of an expanded foam material (such as expanded polypropylene or expanded polyethylene), the foam material has inherent damping properties which may absorb some of the ultrasonic energy. Thus, the effectiveness of the ultrasonic welding process may be limited in some applications.

To overcome these difficulties, the diaphragm components 200*a*, 200*b* may alternatively be joined together using a vibrational welding process, which corresponds substantially to the ultrasonic welding process described above with reference to FIGS. 10A and 10B. The vibrational welding process differs from the ultrasonic welding process in that the dynamic component is moved through a higher reciprocating amplitude and at a lower frequency. That is to say, in each reciprocal movement, the dynamic component is displaced by a greater distance, and the frequency of reciprocal movements is lower. Accordingly, the vibrational welding process is less susceptible to the damping effect of the expanded foam material and thus may be more suitable for welding together diaphragm components formed of an expanded foam material.

The invention has been described above with reference to specific embodiments, given by way of example only. It will be appreciated that different arrangements are possible, which fall within the scope of the appended claims.

The invention claimed is:

1. A method of manufacturing a diaphragm for an audio transducer, the method comprising:

forming a skin shaped so as to define a front outer surface or a rear outer surface of the diaphragm;

forming a support structure;

disposing the support structure on or within the skin;

placing a first expandable material in a first mold and expanding the first expandable material within the first mold to form the support structure; and placing the support structure and a second expandable material in a second mold and expanding the second expandable material within the second mold to form the skin with the support structure disposed within the skin, wherein the first expandable material and the second expandable material are a same material, and wherein a ratio of a mass of expandable material placed within the first mold to a volume of space within the first mold is greater than a ratio of a mass of expandable material placed within the second mold to a volume of space within the second mold.

2. The method according to claim 1, further comprising forming the support structure and subsequently forming the skin around the support structure, such that the support structure is disposed within the skin.

3. The method according to claim 2, wherein the skin is molded over the support structure.

4. The method according to claim 1, wherein the support structure comprises a honeycomb structure, the method further comprising:

forming a first diaphragm component and a second diaphragm component; and joining the first diaphragm component to the second diaphragm component so as to manufacture the diaphragm.

5. The method according to claim 4, wherein the skin is a first skin, wherein the first diaphragm component comprises at least a portion of the honeycomb structure formed integrally with the first skin, wherein the second diaphragm component comprises a second skin, and wherein the method further comprises joining the second diaphragm component to the first diaphragm component so as to dispose the honeycomb structure between the first skin and the second skin.

6. The method according to claim 5, wherein the first diaphragm component comprises the entire honeycomb structure formed integrally with the first skin, and wherein, during said joining the first diaphragm component to the second diaphragm component, the second skin is joined to the honeycomb structure.

7. The method according to claim 5, wherein the first diaphragm component comprises a first portion of the honeycomb structure formed integrally with the first skin, and wherein the second diaphragm component comprises a second portion of the honeycomb structure formed integrally with the second skin, and wherein, during said joining the first diaphragm component to the second diaphragm component, the first portion of the honeycomb structure is joined to the second portion of the diaphragm structure.

8. The method according to claim 4, wherein the first diaphragm component and the second diaphragm component are joined by hot plate welding, ultrasonic welding or vibrational welding.

* * * * *